US010900479B2

(12) United States Patent
Hsu

(10) Patent No.: US 10,900,479 B2
(45) Date of Patent: Jan. 26, 2021

(54) AIR-BAG TYPE INFLATING DEVICE

(71) Applicant: Wen-Chi Hsu, New Taipei (TW)

(72) Inventor: Wen-Chi Hsu, New Taipei (TW)

( * ) Notice: Subject to any disclaimer, the term of this patent is extended or adjusted under 35 U.S.C. 154(b) by 41 days.

(21) Appl. No.: 16/267,016

(22) Filed: Feb. 4, 2019

(65) Prior Publication Data

US 2020/0248679 A1 Aug. 6, 2020

(51) Int. Cl.

*F04B 45/04* (2006.01)
*F04B 53/10* (2006.01)
*F04B 33/00* (2006.01)

(52) U.S. Cl.

CPC ..... *F04B 45/045* (2013.01); *F04B 33/00* (2013.01); *F04B 53/106* (2013.01)

(58) Field of Classification Search

CPC ..... F04B 33/00; F04B 53/106; F04B 45/045
USPC ..... 417/479, 472, 480
See application file for complete search history.

(56) References Cited

U.S. PATENT DOCUMENTS 5,056,992 A * 10/1991 Simons ..... A61M 5/14224 417/474
2009/0155098 A1* 6/2009 Chang ..... F04B 33/00 417/395
2015/0300512 A1* 10/2015 Chen ..... F16K 15/16 137/223

* cited by examiner

*Primary Examiner* — Charles G Freay
*Assistant Examiner* — Chirag Jariwala
(74) *Attorney, Agent, or Firm* — Chun-Ming Shih; HDLS IPR Services

(57) ABSTRACT

An air-bag type inflating device includes an elastic bag body and a sealing member; the sealing member has a first membrane, a second membrane and a third membrane, the second membrane is connected to the first membrane, the third membrane is stacked and arranged at a connecting location of the first membrane and the second membrane and disposed at an inner side of the first membrane; a unidirectional nozzle passage is formed between the first membrane and the third membrane, and capable of being optionally operated for opening or closing the first chamber and the second chamber. Accordingly, an opening/closing status of the unidirectional nozzle passage can be stably and precisely controlled after the bag body is pressed.

10 Claims, 7 Drawing Sheets

AIR-BAG TYPE INFLATING DEVICE

BACKGROUND OF THE INVENTION

Field of the Invention

The present invention relates to an inflating technology, especially to an air-bag type inflating device.

Description of Related Art

A conventional air-bag type inflating device is adopted for processing an inflating operation to a shoe pad of air-cushion shoes, a protection cover of tablet computer, an inflating saddle of bicycle or a protection component of sport gears.

The conventional air-bag type inflating device mainly includes a bag boy and a membrane connected to the bag body, an air inlet valve and an air discharge hole are disposed on the membrane, and a unidirectional nozzle passage is disposed between the bag body and the membrane, the unidirectional nozzle passage has an upper membrane piece and a lower membrane piece, the upper membrane piece and the lower membrane piece are stacked with each other, and edges of the upper membrane piece and edges the lower membrane piece are totally aligned.

However, there are some disadvantages existed while the conventional air-bag type inflating device being in actual use. Because the upper membrane piece and the lower membrane piece are bent and deformed towards the same direction in the unidirectional nozzle passage, the edges of the upper membrane piece and the edges of the lower membrane piece are totally aligned, and there is no gap being formed due to the rear edge of the upper membrane piece and the rear edge of the lower membrane piece are tightly adhered, in other words an inflating operation cannot be processed due to the upper membrane piece and the lower membrane piece being pushed by an external force after the bag body is pressed, thus air inside the bag body is unable to enter an air outlet via the unidirectional nozzle passage, and an inflating effect can only be achieved after a user presses the bag body for many times; as such, the opening/closing control for the conventional air-bag type inflating device is very unstable.

Accordingly, the applicant of the present invention has devoted himself for improving the mentioned disadvantages.

SUMMARY OF THE INVENTION

The present invention is to provide an air-bag type inflating device, in which a unidirectional nozzle passage is configured by each membrane, so that an opening/closing status of the unidirectional nozzle passage can be stably and precisely controlled after a bag body is pressed.

Accordingly, the present invention provides an air-bag type inflating device, which includes an elastic bag body and a sealing member; the elastic bag body has a first chamber and a second chamber separated from each other, one side of the first chamber is formed with a first opening, and one side of the second chamber is formed with a second opening; the sealing member has a first membrane, a second membrane and a third membrane, the first membrane is sealed corresponding to the first opening and extended to a partial area of the second opening, the second membrane is sealed corresponding to the second opening and extended to a partial area of the first opening so as be connected to the first membrane, the third membrane is stacked and arranged at a connecting location of the first membrane and the second membrane and disposed at an inner side of the first membrane; wherein a unidirectional nozzle passage is formed between the first membrane and the third membrane, and capable of being optionally operated for opening or closing the first chamber and the second chamber.

The present invention is also provided with following effects. With a supporting structure configured by a connection part and a fasten part of the unidirectional nozzle passage being connected, the unidirectional nozzle passage can be effectively prevented from being sealed during a pressing operation, thereby avoiding a situation of air being unable to be introduced. With a fifth membrane being stacked and fastened at an inner side of a main part, an opening/closing status of the unidirectional nozzle passage can be stably and precisely controlled after the bag body is pressed.

DETAILED DESCRIPTION OF THE INVENTION

Figure 1:
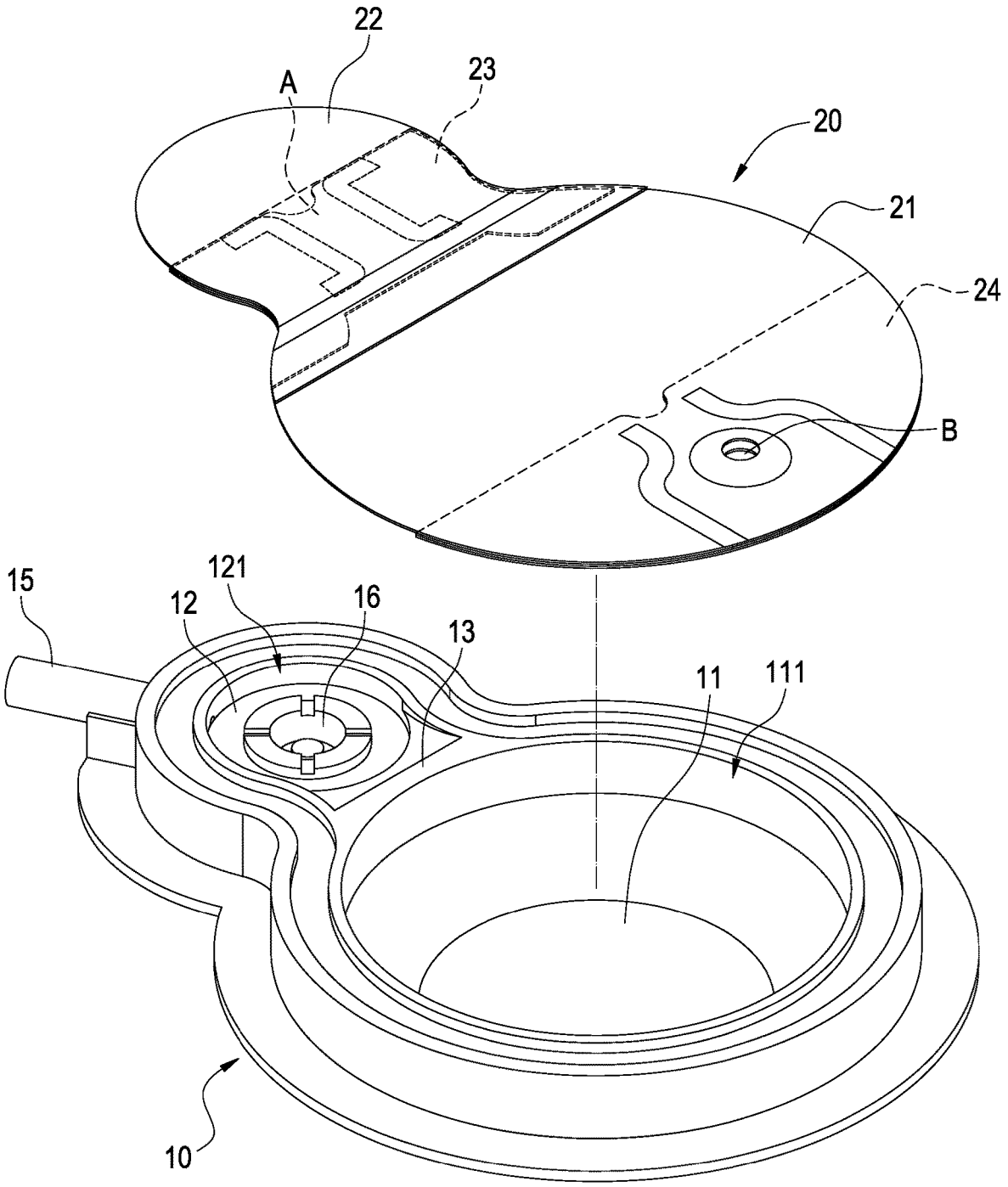
FIG. 1 is a perspective exploded view showing an air-bag type inflating device according to the present invention.
Figure 2:
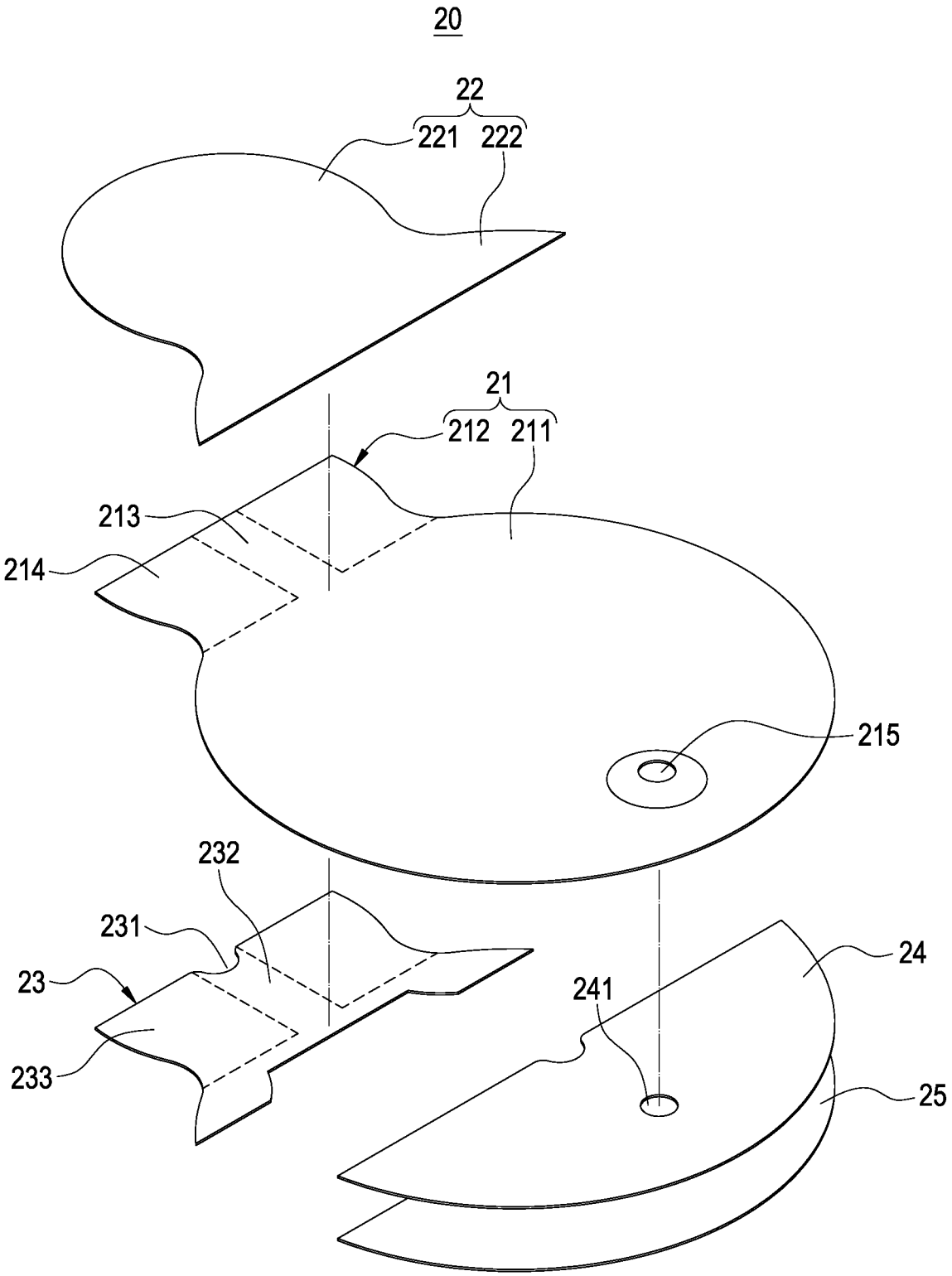
FIG. 2 is an exploded view showing the sealing member according to the present invention.
Figure 3:
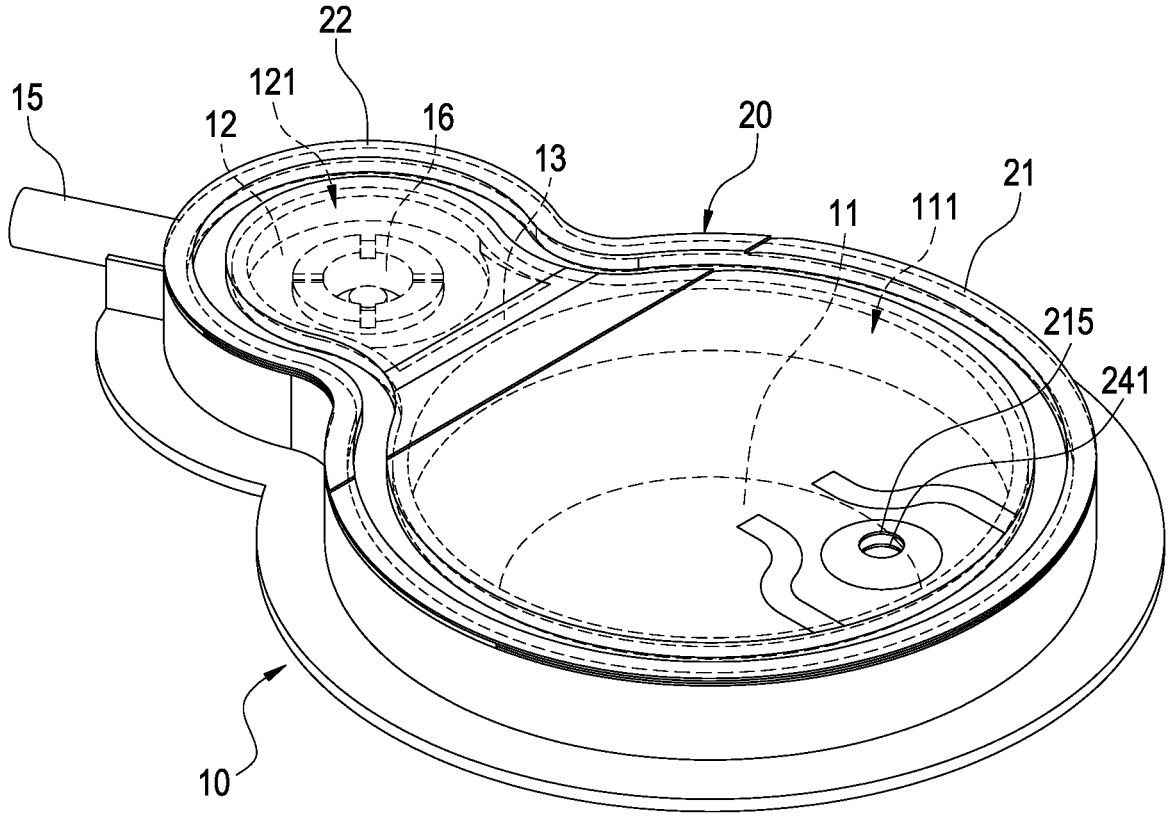
FIG. 3 is a schematic view showing the assembly of the air-bag type inflating device according to the present invention.
Figure 4:
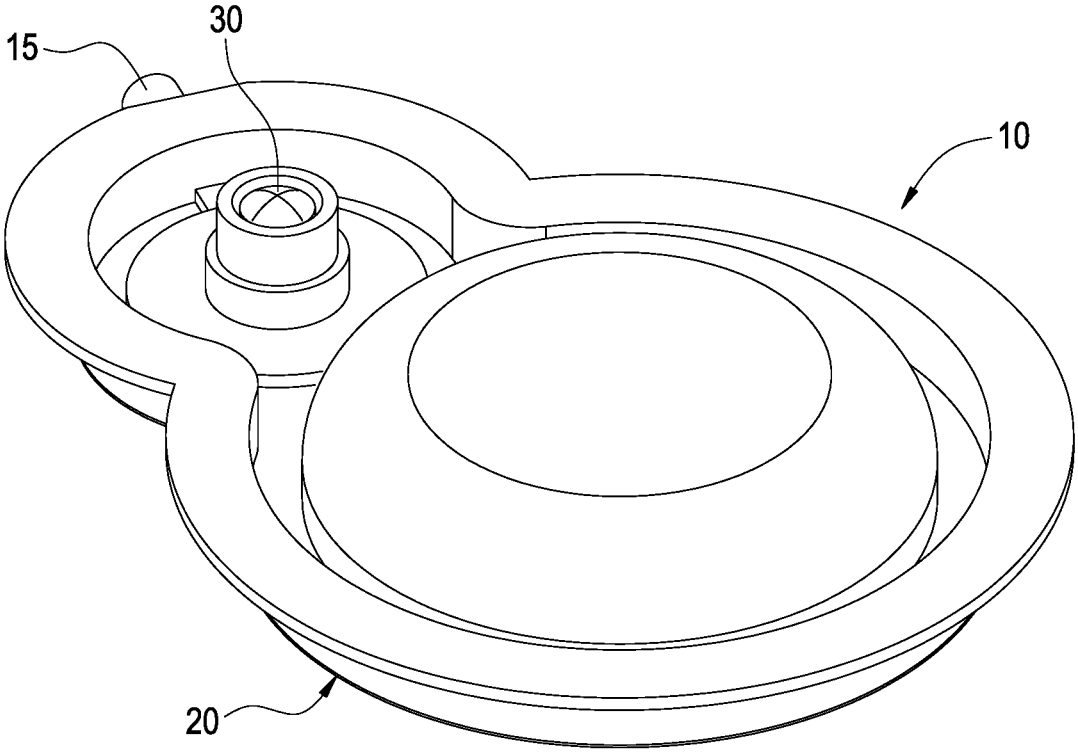
FIG. 4 is another schematic view showing the assembly of the air-bag type inflating device according to the present invention.
Figure 5:
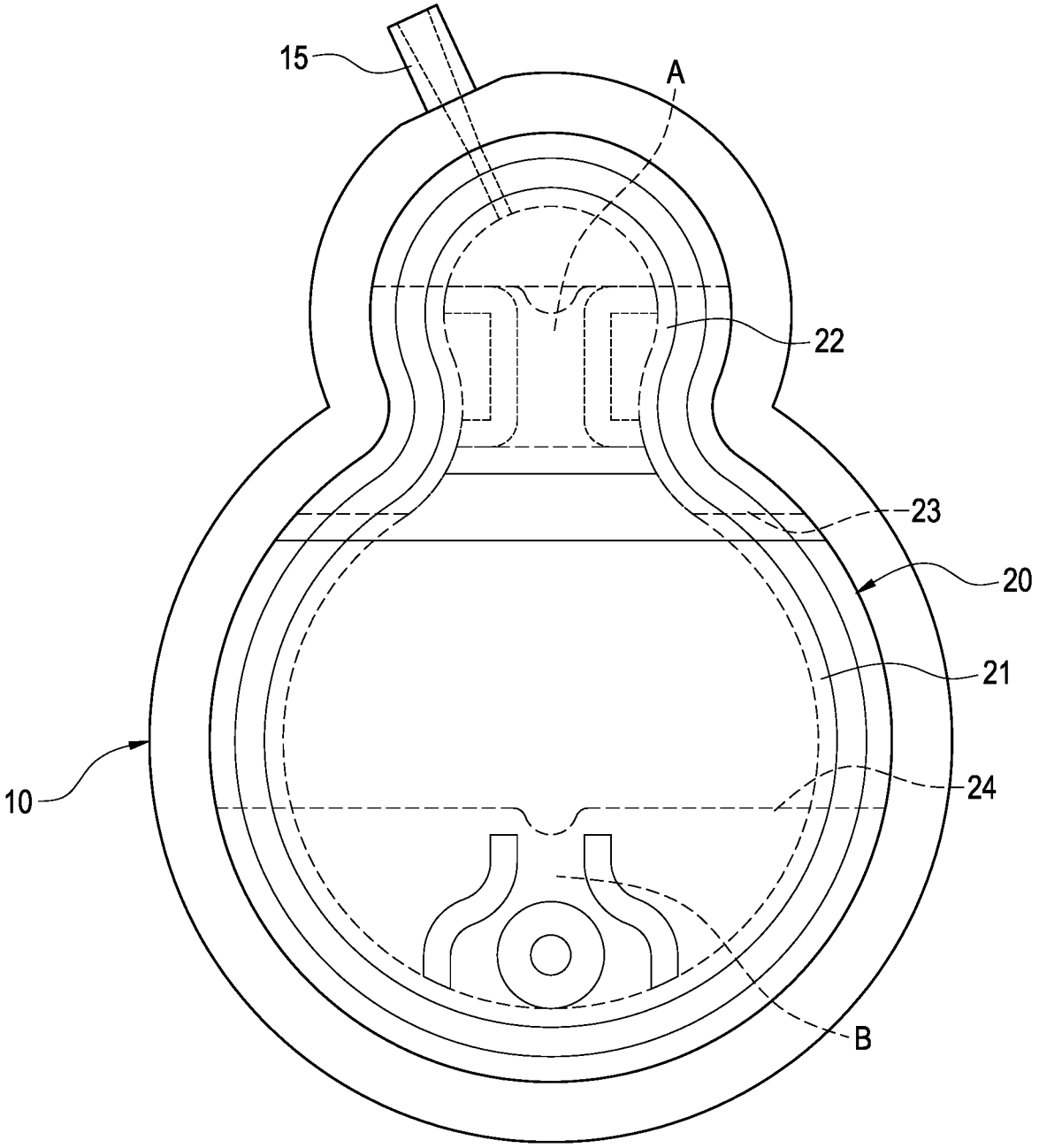
FIG. 5 is a top view showing the assembly of the air-bag type inflating device according to the present invention.
Figure 6:
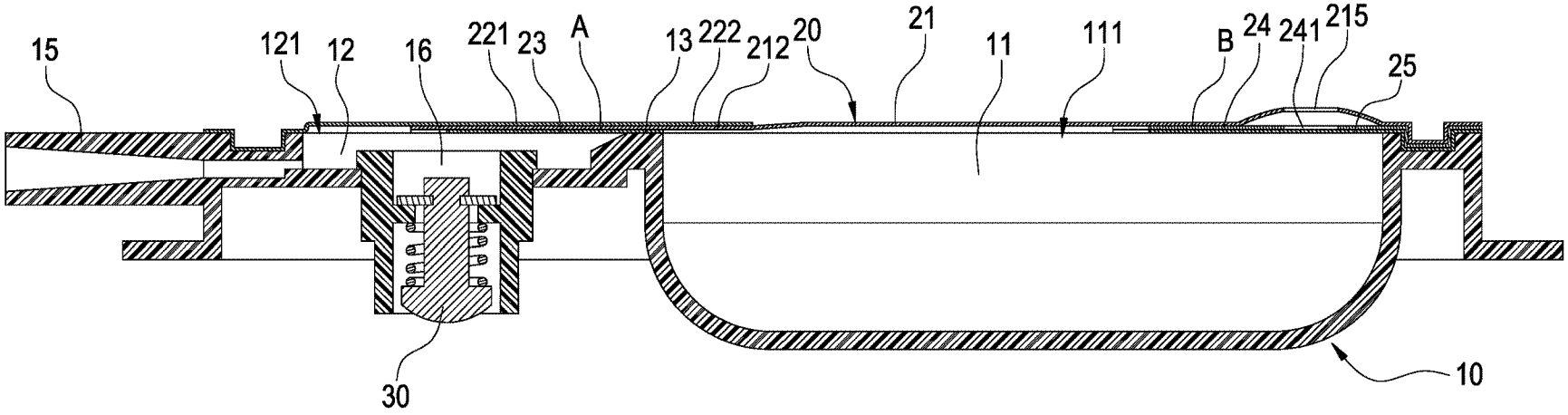
FIG. 6 is a cross sectional view showing the assembly of the air-bag type inflating device according to the present invention.

A preferred embodiment of the present invention will be described with reference to the drawings.

Please refer from FIG. 1 to FIG. 6, an air-bag type inflating device mainly including an elastic bag body 10 and a sealing member 20 is provided by the present invention.

The elastic bag body 10 is made of a rubber material and formed in an 8-like shape. The elastic bag body 10 10 has a first chamber 11 and a second chamber 12. A partition plate 13 is disposed for separating the second chamber 12 and the first chamber 11. A first opening 111 is formed at one side of the first chamber 11, a second opening 121 is formed at one side of the second chamber 12, and the second opening 121 and the first opening 111 are arranged at the same side of the elastic bag body 10. According to this embodiment, the first chamber 11 and the second chamber 12 are both formed in a circular status, but what shall be addressed is that the scope of the present invention is not limited to the above-mentioned circular status. An air discharge pipe 15 communicated with the second chamber 12 is disposed at a lateral side of the second chamber 12, and a valve installing hole 16 is formed at a central location of the second chamber 12.

The sealing member 20 has a first membrane 21, a second membrane 22 and a third membrane 23, and the first membrane 21, the second membrane 22 and the third membrane 23 are all made of a plastic material. The first membrane 21 has a main part 211 and a connection part 212 extended from the main part 211, wherein the main part 211 is sealed corresponding to the first opening 111 and the connection part 212 is extended to a partial area of the second opening 121. A non-adhering zone 213 is formed at an inner central side of the connection part 212, two sides of the non-adhering zone 213 are formed with an adhering zone 214, and a penetrated hole 215 is formed in the main part 211.

The second membrane 22 has a base part 221 and a fasten part 222 extended from the base part 221, wherein the base part 221 is sealed corresponding to the second opening 121, the fasten part 222 is extended to a partial area of the first opening 111 so as to be connected to the first membrane 21. Wherein, the connection part 212 of the first membrane 21 is disposed at an inner side of the fasten part 222 of the second membrane 22.

The third membrane 23 is stacked and arranged at a connecting location of the first membrane 21 and the second membrane 22 and disposed at an inner side of the first membrane 21. Wherein, the first membrane 21, the second membrane 22 and the third membrane 23 are arranged below the partition plate 13, and a notch 231 is formed at an upper central portion of the third membrane 23, and a non-adhering zone 232 is formed at an outer side defined at a lower location corresponding to notch 231. Two sides of the non-adhering zone 232 are formed with an adhering zone 233, wherein each of the adhering zones 233 is correspondingly combined with each of the adhering zones 214 of the connection part 212, and the non-adhering zone 232 is arranged corresponding to the non-adhering zone 213 of the connection part 212.

A unidirectional nozzle passage A is formed between the first membrane 21, the second membrane 22 and the third membrane 23 with a thermal pressing means, in other words the unidirectional nozzle passage A is configured by the base part 221 of the second membrane 22 and the third membrane 23, and disposed between the non-adhering zone 213 of the connection part 212 and the non-adhering zone 232 of the third membrane 23. The unidirectional nozzle passage A is served to allow a communicating status to be formed or closed between the first chamber 11 and the second chamber 12.

Moreover, the sealing member 20 further has a fourth membrane 24 and a fifth membrane 25. The fifth membrane 25 is stacked at an inner side of the fourth membrane 24 and stacked and fastened at an inner side of the main part 211 corresponding to the location of the penetrated hole 215. A through hole 241 is formed on the fourth membrane 24, and an air inlet valve B is formed between the first membrane 21, the fourth membrane 24 and the fifth membrane 25 with a thermal pressing means.

According to the present invention, the air-bag type inflating device further includes a pressure releasing valve 30, the valve installing hole 16 communicated with the second chamber 12 is formed on the elastic bag body 10, and the pressure releasing valve 30 is disposed corresponding to the valve installing hole 16.

Figure 7:
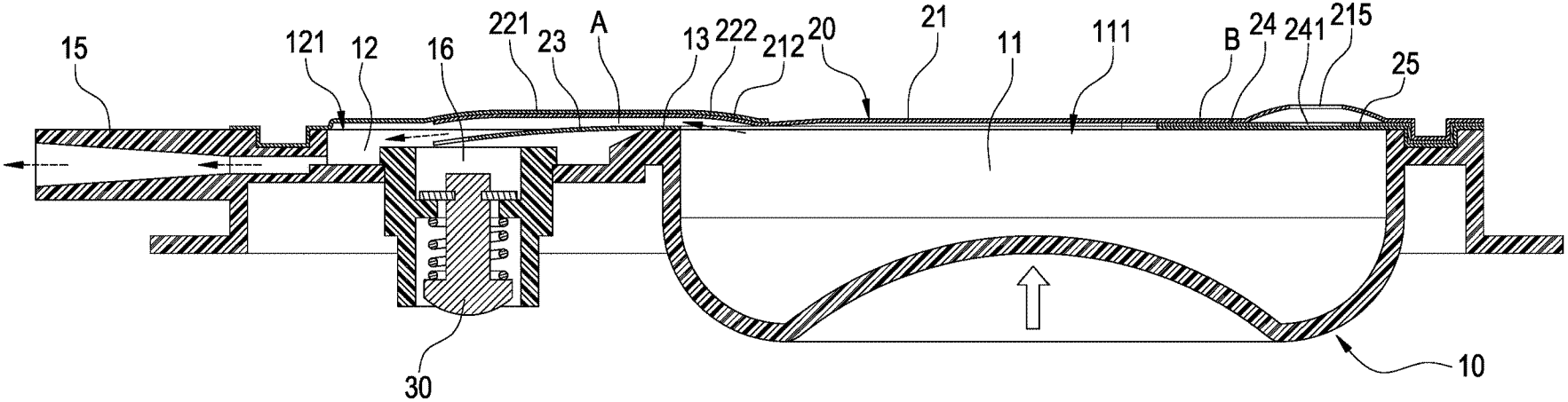
FIG. 7 is a cross sectional view showing an operating status of the air-bag type inflating device according to the present invention.
Figure 8:
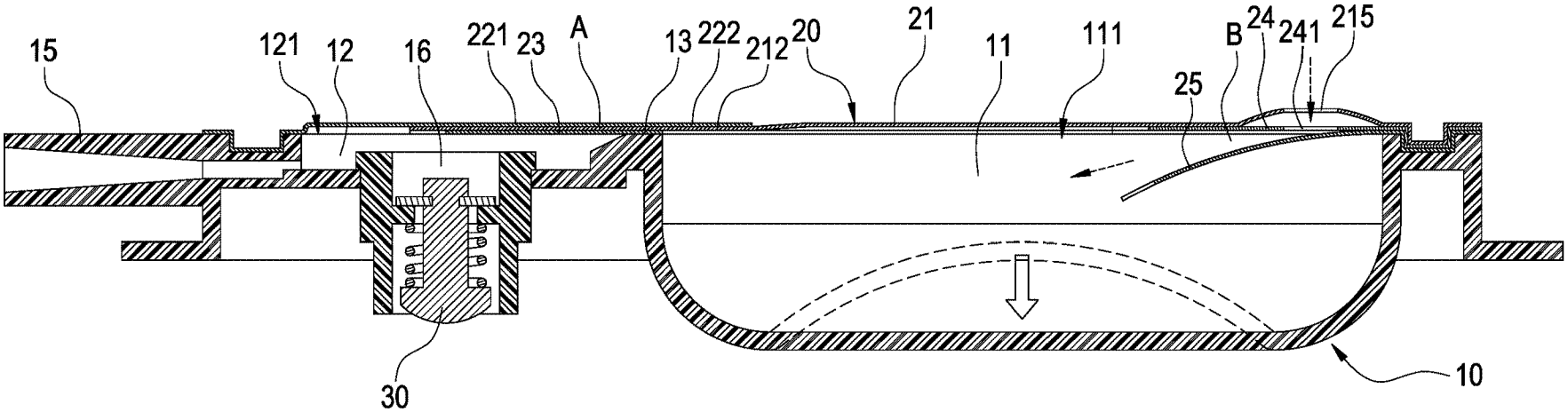
FIG. 8 is a cross sectional view showing another operating status of the air-bag type inflating device according to the present invention.

Please refer to FIG. 7 and FIG. 8, when an inflating operation is desired to be processed, an air inlet of an device to be inflated (not shown in figures) is connected to the air discharge pipe 15, the elastic bag body 10 and the sealing member 20 are pressed by two fingers of a user, so that air inside the first chamber 11 is compressed, at this moment the through hole 241 of the fourth membrane 24 of the air inlet valve B is pressed by the fifth membrane 25 so as to be sealed (in other words the air inlet valve B is closed), a supporting structure configured by the connection part 212 and the fasten part 222 of the unidirectional nozzle passage A being connected is utilized for enabling the compressed flowing air to fully and comprehensively open the unidirectional nozzle passage A so as to enter the second chamber 2, then the air discharge pipe 15 is served to process the inflating operation to the device to be inflated (as shown in FIG. 7); after the pressed elastic bag body 10 and the sealing member 20 are released, the first chamber 11 is formed in a negative pressure status during a process of recovering from being squeezed and deformed, so that the fifth membrane 25 of the air inlet valve B is formed in a raised status, and external air is allowed to be firstly introduced from the penetrated hole 215 then pass the through hole 241 so as to enter the first chamber 11, thereby enabling the above-mentioned process to be repeated until the device to be inflated is sufficiently inflated.

Moreover, when a deflating operation is desired to be processed, an air inlet of a device to be deflated is connected to the air discharge pipe 15, the pressure releasing valve 30 is downwardly pressed, so that air inside the device to be deflated is allowed to enter the second chamber 12 for being discharged through the pressure releasing valve 30, thereby achieving the deflating operation. Accordingly, the air-bag type inflating device provided by the present invention is novel and more practical in use comparing to prior art.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An air-bag type inflating device including:

an elastic bag body, having a first chamber and a second chamber separated from each other, wherein one side of the first chamber is formed with a first opening, and one side of the second chamber is formed with a second opening; and a sealing member, having a first membrane, a second membrane and a third membrane, wherein the first membrane is sealed corresponding to the first opening and extended to a partial area of the second opening, the second membrane is sealed corresponding to the second opening and extended to a partial area of the first opening so as to be connected to the first membrane, the third membrane is stacked and arranged at a connecting location of the first membrane and the second membrane and disposed at an inner side of the first membrane, wherein the third membrane directly contacts the first membrane without contacting the second membrane;

wherein a unidirectional nozzle passage is formed between the first membrane and the third membrane, and capable of being optionally operated for opening or closing the first chamber and the second chamber.

2. The air-bag type inflating device according to claim 1, wherein a partition plate is disposed for separating the second chamber and the first chamber, and the first membrane, the second membrane and the third membrane are arranged below the partition plate.

3. The air-bag type inflating device according to claim 1, wherein the first opening and the second opening are arranged at a same side of the elastic bag body.

4. The air-bag type inflating device according to claim 1, wherein the sealing member further has a fourth membrane and a fifth membrane, the fifth membrane is stacked at an inner side of the fourth membrane, the first membrane has a main part, a penetrated hole is formed on the main part, the fifth membrane is stacked and fastened at an inner side of the main part corresponding to a location of the penetrated hole, a through hole is formed on the fourth membrane, so that an air inlet valve is formed between the first membrane, the fourth membrane and the fifth membrane.

5. The air-bag type inflating device according to claim 1, wherein an air discharge pipe communicated with the second chamber is disposed at a lateral side of the second chamber.

6. The air-bag type inflating device according to claim 1, further including a pressure releasing valve, a valve installing hole communicated with the second chamber is formed on the elastic bag body, and the pressure releasing valve is disposed corresponding to the valve installing hole.

7. The air-bag type inflating device according to claim 1, wherein the first membrane has a main part and a connection part extended from the main part, the main part is sealed corresponding to the first opening, and the connection part is extended to a partial area of the second opening.

8. The air-bag type inflating device according to claim 7, wherein the second membrane has a base part and a fasten part extended from the base part, the base part is sealed corresponding to the second opening, and the fasten part is extended to a partial area of the first opening so as to be connected to the first membrane.

9. The air-bag type inflating device according to claim 8, wherein a non-adhering zone is formed at a central location of the connection part, another non-adhering zone is formed at a central location of the third membrane, and the unidirectional nozzle passage is formed between the non-adhering zone and the another non-adhering zone.

10. The air-bag type inflating device according to claim 8, wherein the connection part of the first membrane is disposed at an inner side of the fasten part of the second membrane.

* * * * *